US012320214B2

(12) United States Patent
Varkey et al.

(10) Patent No.: US 12,320,214 B2
(45) Date of Patent: Jun. 3, 2025

(54) ANCHOR ASSEMBLIES FOR USE ON A CABLE AND PROCESSES FOR USING SAME

(71) Applicant: Schlumberger Technology Corporation, Sugar Land, TX (US)

(72) Inventors: Joseph Varkey, Sugar Land, TX (US); Mathew Varghese, Abu Dhabi (AE)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/428,463

(22) Filed: Jan. 31, 2024

(65) Prior Publication Data

US 2024/0254845 A1 Aug. 1, 2024

Related U.S. Application Data

(60) Provisional application No. 63/482,457, filed on Jan. 31, 2023.

(51) Int. Cl.

| | |
|---|---|
| ***E21B 23/01*** | (2006.01) |
| ***E21B 23/00*** | (2006.01) |
| ***E21B 23/14*** | (2006.01) |

(52) U.S. Cl.

CPC ..... *E21B 23/01* (2013.01); *E21B 23/001* (2020.05); *E21B 23/14* (2013.01)

(58) Field of Classification Search

CPC ..... E21B 23/01; E21B 23/001; E21B 23/14; E21B 31/18

See application file for complete search history.

(56) References Cited

U.S. PATENT DOCUMENTS

| | | | | |
|---|---|---|---|---|
| 6,707,360 | B2 | 3/2004 | Underwood et al. | |
| 7,012,495 | B2 | 3/2006 | Underwood et al. | |
| 7,441,507 | B2 * | 10/2008 | Teraura | B08B 9/049 104/282 |
| 2004/0239460 | A1 | 12/2004 | Kocijan | |
| 2005/0284233 | A1 * | 12/2005 | Teraura | E21B 23/14 73/779 |
| 2008/0073077 | A1 * | 3/2008 | Tunc | E21B 23/14 166/241.5 |
| 2016/0215578 | A1 * | 7/2016 | Adnan | E21B 23/01 |
| 2018/0179840 | A1 * | 6/2018 | Varkey | E21B 23/01 |
| 2020/0024920 | A1 * | 1/2020 | Varkey | E21B 17/1014 |
| 2024/0167351 | A1 * | 5/2024 | Murphy | E21B 17/021 |

* cited by examiner

*Primary Examiner* — Steven A MacDonald

(74) *Attorney, Agent, or Firm* — Ashley E. Brown

(57) ABSTRACT

Anchor assemblies for use on a downhole cable and processes for using same. In some embodiments, the anchor assembly can include a first anchor configured to be releasably connected to a second anchor. The first anchor can define a bore therethrough that can be configured to receive and permit a cable to move therethrough such that the cable can be connected to the second anchor. The second anchor can include one or more switchable magnets each configured to switch between a non-magnetized state and a magnetized state. When the anchor assembly is located within a downhole casing and the one or more switchable magnets are switched from the non-magnetized state to the magnetized state, the one or more switchable magnets can be configured to secure the second anchor to an inner surface of the downhole casing.

22 Claims, 5 Drawing Sheets

ANCHOR ASSEMBLIES FOR USE ON A CABLE AND PROCESSES FOR USING SAME

CROSS-REFERENCE TO RELATED APPLICATION

This application claims priority to U.S. Provisional Patent Application No. 63/482,457, filed on Jan. 31, 2023, which is incorporated by reference herein.

FIELD

Embodiments described generally relate to anchor assemblies for use on a cable and processes for using same. More particularly, such embodiments relate to anchor assemblies for use on a cable located within a downhole casing, the anchoring assemblies configured to permit or apply a tension to the cable and processes for using same.

BACKGROUND

In a well, particularly, a horizontal section of a well, polymer a locked cable that includes one or more optical fibers can be used to monitor fracking operations therein. The optical fiber(s) can be used as a sensor to monitor the path of the frac fluids to assess the effectiveness and control the frac treatment. In a horizontal well it can be difficult to maintain the cable under tension while pumping fluids in the well. Additionally, the possibility the cable being damaged when not under sufficient tension can increase the likelihood the cable will be damaged when the cable is lying across a perforated section of the casing in the well.

There is a need, therefore, for anchor assemblies for use on cables located within a downhole casing, the anchor assemblies configured to permit or apply a tension to the cable and processes for using same.

SUMMARY

Anchor assemblies for use on a downhole cable and processes for using same are provided. In some embodiments, the anchor assembly can include a first anchor configured to be releasably connected to a second anchor. The first anchor can define a bore therethrough that can be configured to receive and permit a cable to move therethrough such that the cable can be connected to the second anchor. The second anchor can include one or more switchable magnets each configured to switch between a non-magnetized state and a magnetized state. When the anchor assembly is located within a downhole casing and the one or more switchable magnets are switched from the non-magnetized state to the magnetized state, the one or more switchable magnets can be configured to secure the second anchor to an inner surface of the downhole casing.

In some embodiments, a process for conveying an anchor assembly into a downhole casing can include conveying the anchor assembly via a cable to a location of interest within the downhole casing. The anchor assembly can include a first anchor releasably connected to a second anchor. The first anchor can define a bore therethrough that the cable passes through such that the cable can be connected to the second anchor. The second anchor can include one or more switchable magnets each configured to switch between a non-magnetized state and a magnetized state. The process can also include activating the first anchor to cause a plurality of arms to radially expand outward with a sufficient radial force to secure the first anchor to an inner surface of the downhole casing. The process can also include releasing the second anchor from the first anchor upon activation of the first anchor. The process can also include moving the second anchor further into the downhole casing away from the first anchor such that a portion of the cable spans a distance between the first anchor and the second anchor. The process can also include switching the one or more switchable magnets from the non-magnetized state to the magnetized state to secure the second anchor to the inner surface of the downhole casing. The process can also include applying a tension to the cable from a surface location by applying a force to the cable.

In other embodiments, a process for conveying an anchor assembly into a downhole casing can include conveying the anchor assembly via a cable to a location of interest within the downhole casing. The anchor assembly can include a first anchor releasably connected to a second anchor. The first anchor can define a bore therethrough that the cable passes through such that the cable can be connected to the second anchor. The first anchor can include a plurality of wheels configured to engage with the cable disposed within the bore defined by the first anchor. The first anchor can also include one or more switchable magnets each configured to switch between a non-magnetized state and a magnetized state. The second anchor can include one or more switchable magnets each configured to switch between a non-magnetized state and a magnetized state. The process can include switching the one or more switchable magnets in the second anchor from the non-magnetized state to the magnetized state to secure the second anchor to an inner surface of the downhole casing. The process can also include releasing the first anchor from the second anchor upon activation of the second anchor. The process can also include activating the plurality of wheels within the first anchor to move the first anchor toward a surface location and away from the second anchor such that a portion of the cable spans a distance between the first anchor and the second anchor. The process can also include switching the one or more switchable magnets in the first anchor from the non-magnetized state to the magnetized state to secure the first anchor to the inner surface of the downhole casing. The process can also include applying a tension to the cable from a surface location by applying a force to the cable.

BRIEF DESCRIPTION OF THE DRAWINGS

The subject disclosure is further described in the detailed description which follows, in reference to the noted plurality of drawings by way of non-limiting examples of the subject disclosure, in which like reference numerals represent similar parts throughout the several views of the drawings.

DETAILED DESCRIPTION

Figures 1, 2:
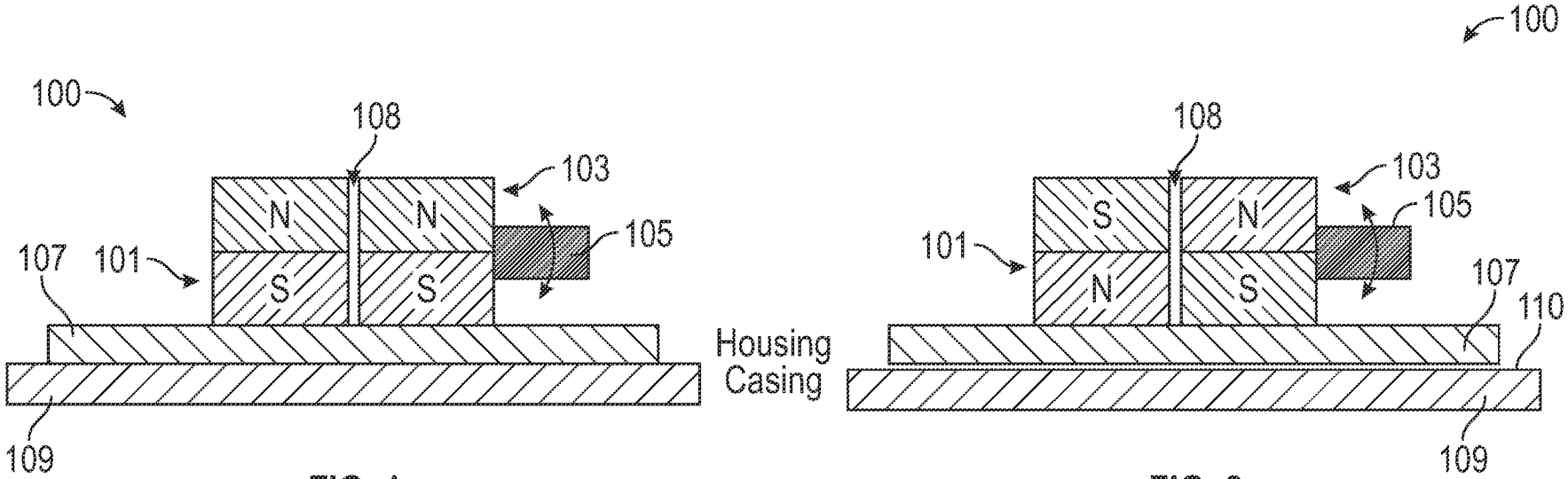
FIG. 1 depicts a cross-sectional elevation view of an illustrative switchable magnet in an on position, according to one or more embodiments described.
FIG. 2 depicts a cross-sectional elevation view the switchable magnet in FIG. 1 in an off position, according to one or more embodiments described.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions can be made to achieve certain goals, such as compliance with system-related and/or operation-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Certain examples commensurate in scope with the claimed subject matter are discussed below. These examples are not intended to limit the scope of the disclosure. Indeed, the present disclosure may encompass a variety of forms that may be similar to or different from the examples set forth below.

It should be understood that the formation of a first feature about, over, or on a second feature in the description that follows includes embodiments in which the first and second features are formed in direct contact and also includes embodiments in which additional features are formed interposing the first and second features, such that the first and second features are not in direct contact or directly adjacent to one another. The exemplary embodiments presented below may be combined in any combination of ways, i.e., any element from one exemplary embodiment may be used in any other exemplary embodiment, without departing from the scope of the disclosure. The figures are not necessarily drawn to scale and certain features and certain views of the figures can be shown exaggerated in scale or in schematic for clarity and/or conciseness.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. Furthermore, the phrase A "based on" B is intended to mean that A is at least partially based on B. Moreover, unless expressly stated otherwise, the term "or" is intended to be inclusive (e.g., logical OR) and not exclusive (e.g., logical XOR). In other words, the phrase A "or" B is intended to mean A, B, or both A and B.

Overview

The anchor assemblies and processes disclosed herein can be used to permit or apply a tension on a cable located within a downhole casing. The anchor assemblies can include, but are not limited to, a first or an "upper" anchor and a second or a "lower" anchor. The upper anchor can be located closer to the surface of the earth than the lower anchor when the anchor assemblies are located within a downhole casing. The upper anchor can include a release mechanism that can separate the lower anchor from the upper anchor. The cable can pass through the upper anchor and can be terminated in the lower anchor. In some embodiments, the lower anchor can be electrically connected to a logging cable and can include electronics for control and communication with a surface acquisition system.

The anchoring mechanism in the lower anchor device can include one or more switchable magnets. The magnets can be permanent magnets. In some embodiments, the magnets can be neodymium-based magnets, e.g., neodymium-iron-born magnets. The switchable magnets can be switched from an "off" position or non-magnetized state to an "on" position or magnetized state to secure the lower anchor to an inner wall of the casing. The switchable magnets can be switched from the "on" position to the "off" position to release the lower anchor from the casing by a physical change of position of the permanent magnet inside. In some embodiments, the physical position of the magnet can be changed using an electro-hydraulic device. The anchoring force can depend, at least in part, on the size, length, and strength of the magnets used. In some embodiments, the upper anchor can include a spring centralizer device that can be opened and closed inside the casing. In other embodiments, the upper anchor can also include one or more switchable magnets. The upper anchor can be secured to the casing, centralize the cable, and allow free movement of the cable through a bore defined by the upper anchor.

In some embodiments, when the upper and lower anchors have been secured to the casing, a tension can be applied to the cable via surface equipment, e.g., a spool the cable can be reeled on can be turned to apply the tension. In other embodiments, when the upper and lower anchors have been secured to the casing, a tension can be applied to the cable via the surface equipment and/or, in some embodiments, via one or more wheels that can be disposed within the first anchor that can be configured to engage with and apply a force to the cable.

With the tension applied one or more downhole operations can be carried out. For example, the cable can include one or more optical fibers that can be used as a sensor to monitor a path of frac fluids after a fracking operation to assess the effectiveness and control the frac treatment.

Once the downhole operation has been carried out, the lower anchor can be released by switching the switchable magnets form the on position to the off position, the cable can be used to pull the lower anchor into engagement with the upper anchor, which can cause the upper anchor to be released and the anchor assembly can be retrieved from the downhole casing or moved to another location therein.

FIGS. 1 and 2 depict a cross-sectional elevation view of an illustrative switchable magnet 100 in an on position and an off position, respectively, according to one or more embodiments. The switchable magnet 100 can include a first permanent magnet 101 and a second permanent magnet 103 adjacent or proximate one another. The switchable magnet 100 can be switchable between a magnetized state ("on position") and a non-magnetized state ("off position").

In some embodiments, the switchable magnet 100 can be switched between the on position and the off position via a handle or switch 105. For example, turning the switch 105 can rotate the first magnet 101 (as shown) or the second magnet 103 to switch the magnet between the on position and the off position and vice versa. The switchable magnet 100 can be located within a downhole tool housing 107. In use the downhole tool housing 107 can be disposed within a downhole casing or simply casing 109 and placed into contact with an inner surface 110 of the casing 109 and the switchable magnet 100 can be switched to the on position to secure the housing 107 to the casing 109, as described in more detail below.

In some embodiments, the switchable magnet 100 can include a housing 106 (see FIG. 6) that can at least partially house or enclose the magnets 101, 103 disposed therein. The housing 106 can maintain the magnets 101, 103 in a proper position with respect to one another when the magnet is in the on position and the off position. In one or more embodiments, the housing 106 can be or include one or more materials having a low magnetic reluctance. The low magnetic reluctance materials can be ferrimagnetic or ferromagnetic ("magnetically susceptible material"). In some embodiments, within the housing 106, the first magnet 101 can be held in a fixed position relative to the second magnet 103 that can be rotated about its axis. In other embodiments, within the housing 106, the second magnet 103 can be held in a fixed position relative to the second magnet 101 that can be rotated about its axis, as shown in FIGS. 1 and 2. In some embodiments, the lower surface of the lower magnet can form part of a lower surface or "contact side" of the switchable magnet 100 (not shown). In other embodiments, as shown, a side of each of the first and second magnets 101, 103 can form part of a lower surface or "contact side" of the switchable magnet 100.

Rotating the first or the second magnet 101, 103 by about 180° about its axis can align the poles of both the first magnet and the second magnet in the "on" position to produce an external magnetic field. When so aligned, the north (positive) and south (negative) poles of the second magnet 103 can substantially overlie the north and south poles of the first magnet 101, creating a strong external magnetic field about the housing 106. At least a portion of the strong external magnetic field can be directed toward the contact side of the switchable magnet 100.

In one or more embodiments, the housing 106 can be or can include one or more pole pieces that can enhance the magnetic functionality of the switchable magnet 100. The shape or wall thickness of the pole pieces forming the housing 106 can increase or decrease the external magnetic field strength. For example, to provide a higher external magnetic field, the pole pieces can be shaped in such a way that they reflect the variation of the magnetic field strength around the perimeter of the permanently magnetized first and second magnets 101, 103. In some embodiments, a piece of material 108 can be disposed between the two magnets 101, 103. In such embodiment, the material 108 can reduce friction between the two magnets 101, 103 when one of the magnets 101, 103 is rotated about its axis. For example, the material can be a polymer such as polytetrafluoroethylene. In some embodiments, suitable switchable magnets that can be used can include those described in U.S. Pat. Nos. 6,707,360 and 7,012,495 and U.S. patent Application Publication No.: 2004/0239460.

Figure 3:
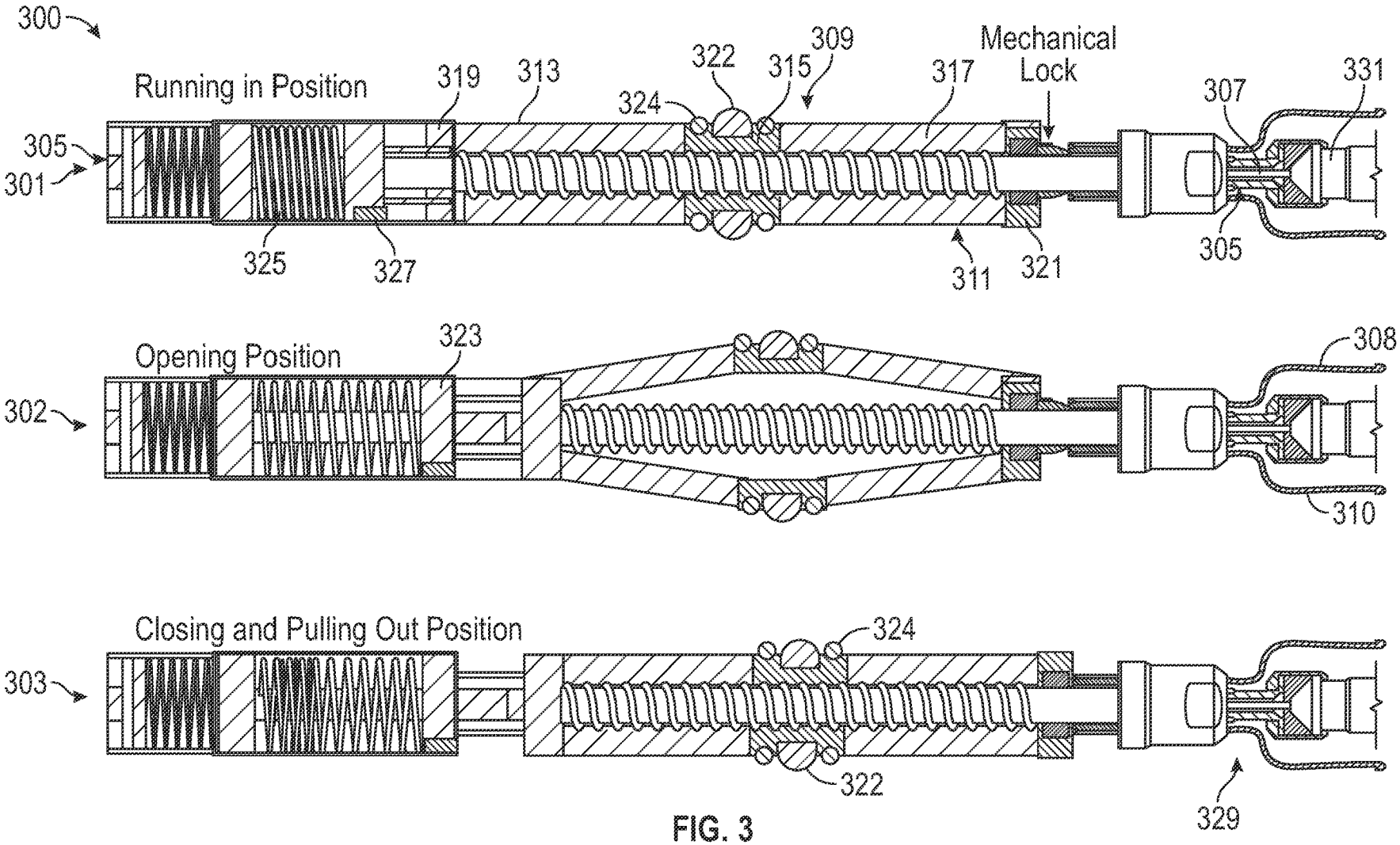
FIG. 3 depicts an illustrative upper anchor in a run-in configuration, an open configuration, and a closed and pull-out configuration, according to one or more embodiments described.

FIG. 3 depicts an illustrative upper anchor 300 in a run-in configuration 301, an open configuration 302, and a closed and pull-out position 303, according to one or more embodiments.

The upper anchor 300 can define a concentric hole or bore 305 that can be configured to pass a cable 307 through. In some embodiments, the bore 305 can be lined with a suitable material, e.g., a polymer, that can reduce or prevent damage to a jacket of the cable 307. In some embodiments, the cable 307 can be a polymer-locked cable that can include one or more optical fibers. In some embodiments, the optical fiber (s) can be used as a sensor to monitor the path of frac fluids after a fracking operation to assess the effectiveness and control the frac treatment.

In some embodiments, the upper anchor 300 can include three arms located at 120 degrees orientation or two arms that can be diametrically opposite one another. as shown in FIG. 3, the upper anchor 300 includes two arms 309, 311 diametrically opposed to one another. The arms 309, 311 can be opened outward radially and closed based on the position of the upper and lower ends of a spring arm assembly. In some embodiments, each arm 309, 311 can include three linkages 313, 315, 317 connected to hubs 319, 321. The movement of the hubs 319, 321 on either side of the arms 309, 311 can control the opening and closing of the arms 309, 311. When the arms 309, 311 are in the open position, the arms 309, 311 can engage with an inner wall of a casing 109 (see FIG. 1) and exert a sufficient radial force that can secure or anchor the upper anchor 300 within the casing 109.

Figure 4:
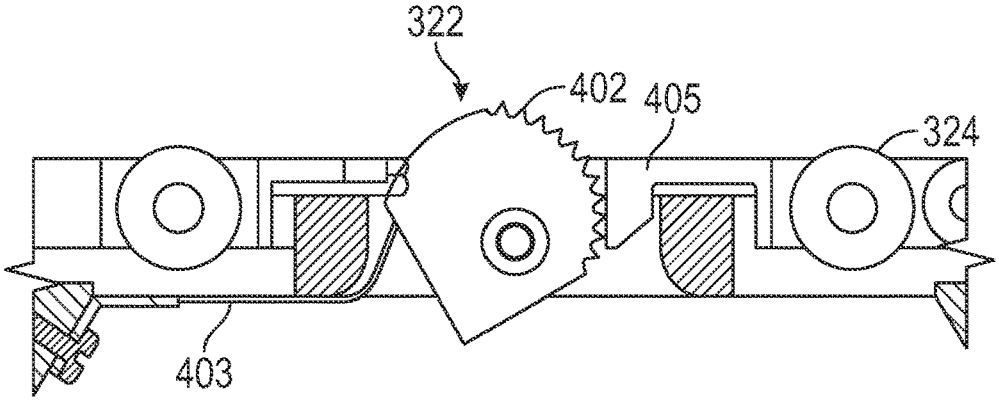
FIG. 4 depicts a close-up view of an illustrative spring cam of the upper anchor, according to one or more embodiments described.

In some embodiments, the linkage 315 that can engage with the inner surface of the casing 109 can be equipped with a mechanical spring cam 322 that can bite into the casing 109 in one direction and slip in the other direction. In some embodiments, the linkage 315 that can engage with the inner surface of the casing 109 can also be equipped with one or more rollers 324 that can facilitate movement of the casing 109 in one direction and slip in the other direction. FIG. 4 depicts a close-up view of an illustrative spring cam 322, according to one or more embodiments.

As shown in FIG. 4, the spring cam 322 can include a plurality of teeth 402 that can bite into the casing 109 in one direction to prevent the upper anchor 300 from moving further down the casing 109 while allowing the spring cam 321 to slip and permit the upper anchor 300 to move toward the surface. The cam 321 can also include a spring 403 that can urge the cam 321 to rotate such that the teeth 402 can engage with the inner surface of the casing 109. As such, once the arms 309, 311 are in the open position, the upper anchor 300 can be prevented from moving further down the casing 109 but can permit the upper anchor 300 to be moved up freely in the casing 109 toward the surface.

The upper end of the upper anchor 300 can include a hydraulically operated piston 323 that can be pumped against a strong compression spring 325 and locked with the use of a solenoid valve 327. This action can store energy in the spring 325 that can be used to open the arms 309, 311 downhole. In the locked position, the upper end of the arms 309, 311 can be free to move when the piston 323 is pumped hydraulically at surface of the earth to compress the spring 325. This can keep the upper anchor 300 in a closed position. In some embodiments, the solenoid 327 can be connected to the lower anchor tool (not shown) using electrical wires 308, 310 and the solenoid operation 327 can be controlled using the lower anchor tool (not shown). The upper anchor 300 can include a collet assembly 329 that can catch a fishing head neck 331 of the lower anchor tool (not shown). The wires 308, 310 can be connected through fluid to air feedthroughs to connect the upper anchor 300 and the lower anchor. The signal to control the solenoid 327 in the upper anchor 300 can be sent through these wires.

In some embodiments, when the upper anchor 300 is deployed by activating the solenoid 327, the movement of the piston 323 also actuate the release of the fishing head neck 331 at the end of the stroke. In other embodiments, an electromechanical release can be configured to release the lower anchor fishing head neck 331. In some embodiments, the position of the lower end of the arms 309, 311 can be locked using a mechanical lock mechanism. When the fishing head neck 331 is pulled into collet assembly 329 of the upper anchor 300 using the cable 307, the cable 307 overpull can move a tube that can release the mechanical lock. This can cause the lower end of the arms 309, 311 to become free and allow the arms 309, 311 to be closed. The lower anchor (not shown) can be connected to the production logging tool, and it can be anchored using a command from the surface via the cable 307. The lower anchor can operate with the same magnetic principle as described above with reference to FIGS. 1 and 2.

In some embodiments, the upper anchor 300 can be a passive device that can be triggered, i.e., moved from the closed position to the open position via a mechanical action. In other embodiments, the upper anchor 300 can be an active device that can include a motor and electronics that can be powered via a wet connection between the bottom of the upper anchor 300 and the collet assembly 329.

Figure 5:
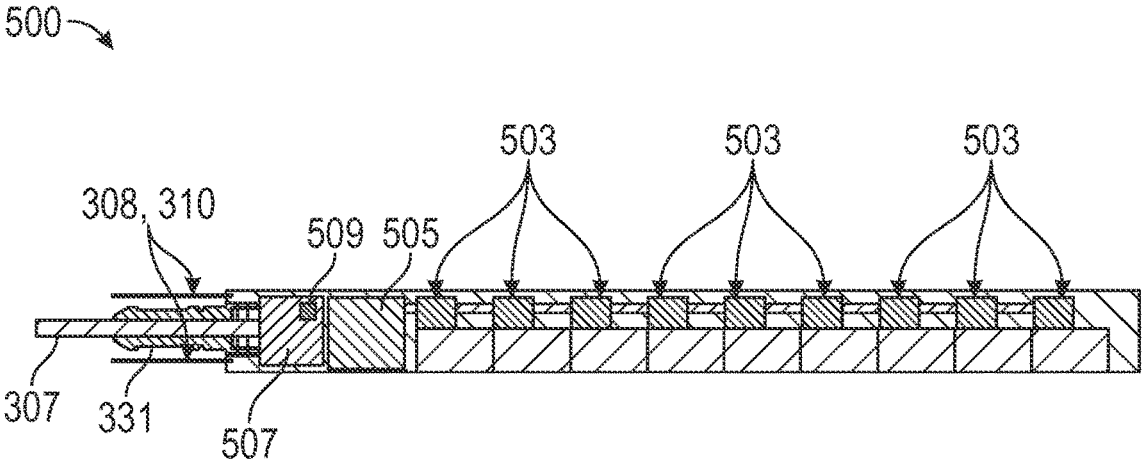
FIG. 5 depicts an illustrative lower anchor that includes a plurality of switchable magnets, according to one or more embodiments described.
Figure 6:
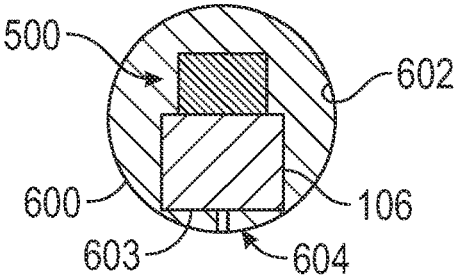
FIG. 6 depicts an end view of the lower anchor disposed within a downhole casing, according to one or more embodiments described.

FIG. 5 depicts an illustrative lower anchor 500 that includes a plurality of switchable magnets 503, according to one or more embodiments. FIG. 6 depicts an end view of the lower anchor 500 disposed within a downhole casing 109, according to one or more embodiments. The plurality of switchable magnets 503 can include 2, 3, 4, 5, 6, 7, 8, 9, 10, or more switchable magnets. The number and/or size of the switchable magnets 503 can depend, at least in part, on an inner diameter of the casing 109, a wall thickness of the casing 109, a curvature of the inner surface 110 of the casing 109, a distance the upper anchor 300 and the lower anchor 500 are to be located from one another, the diameter of the cable 307, a weight of the cable 307, and the like.

The lower anchor 500 can include a mechanism configured to switch the switchable magnets 503 between the off state and the on state and vice versa. The switchable magnets 503 can be constructed in the same or a similar manner as the switchable magnet 100 described above with reference to FIGS. 1 and 2. In some embodiments, an electro-hydraulic unit or device 505 can be used to actuate the switchable magnets 503. In some embodiments, the electro-hydraulic device 505 can receive signals from an electronics unit 507 indicating the switchable magnets 503 should be switched between the off position to the on position and vice versa. In some embodiments, the electronics unit 507 and/or the electro-hydraulic device 505 can receive power from the surface via the cable 307. In some embodiments, each switchable magnet 503 can be switched between the off position and the on position or vice versa at substantially the same time. In other embodiments, each switchable magnet 503 can be independently switched between the off position and the on position or vice versa such that the switchable magnets 503 can be actuated at the same time or different times with respect to one another. In some embodiments, the lower anchor 500 can include a timed fail-safe mechanism 509 that can release the anchor automatically in the event of power failure and/or after a predetermined period of time has elapsed after the lower anchor 500 was secured to the inner surface 110 of the downhole casing 109.

As shown in FIG. 6, in some embodiments, a gap 604 can be present between a portion of a bottom 603 of the housing 106 that contains the switchable magnet 500 and the inner surface 110 of the casing 109. In other embodiments, the bottom of the housing 603 can be contoured and configured such the gap 604 can be substantially eliminated or completely eliminated.

Figure 7:
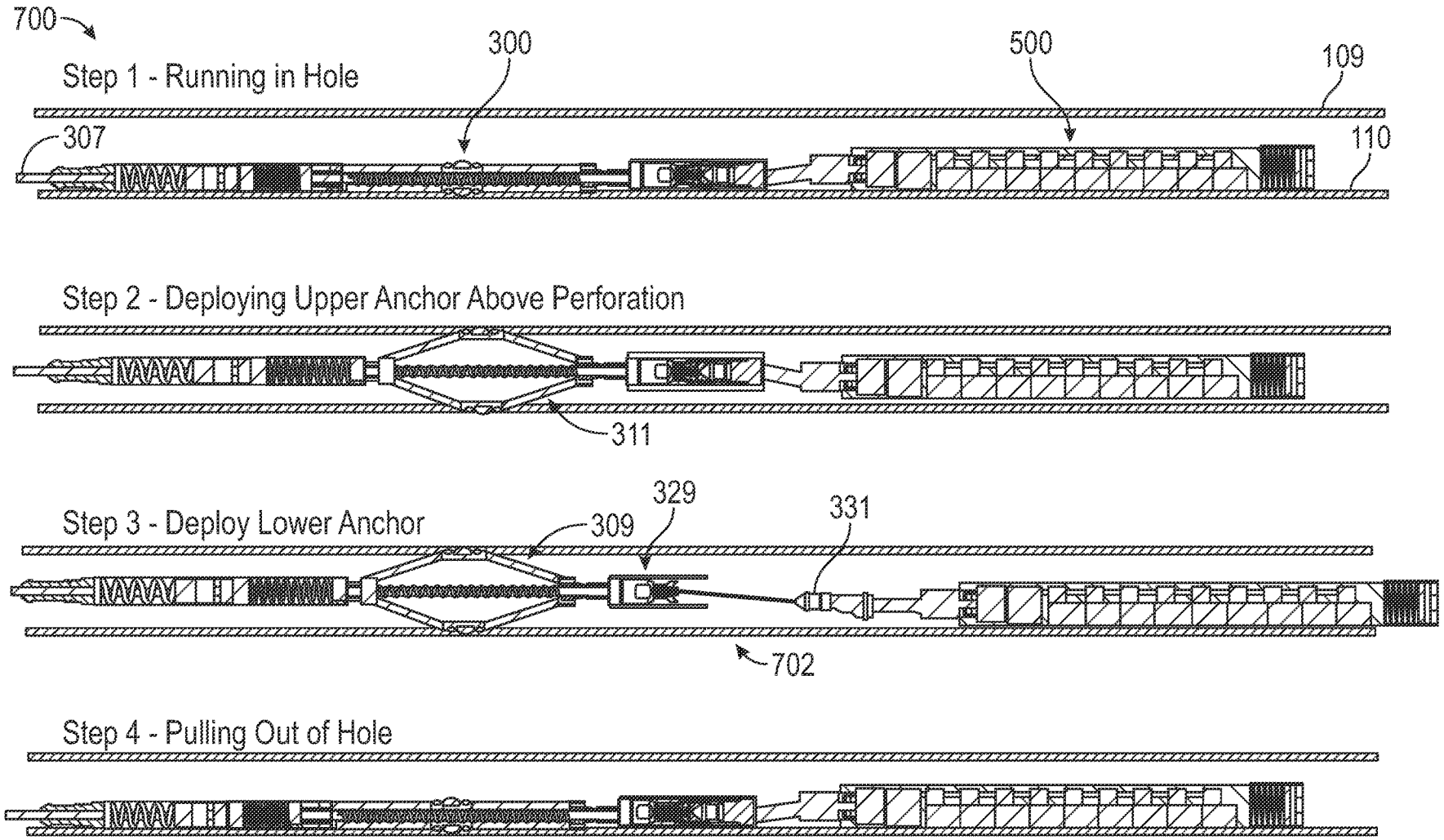
FIG. 7 depicts an illustrative anchor assembly that includes an upper anchor and a lower anchor in a running in position, the upper anchor in a deployed configuration, the lower anchor in a deployed configuration, and the upper anchor and the lower anchors in a closed and pull-out configuration, according to one or more embodiments described.

FIG. 7 depicts an illustrative anchor assembly 700 that includes the upper anchor 300 and the lower anchor 500 in a run-in configuration, the upper anchor 300 in a deployed configuration, the upper anchor 300 an the lower anchor 500 in a deployed configuration, and the upper anchor 300 and the lower anchor 500 in a closed and pull-out configuration, according to one or more embodiments. At the desired depth above a perforation 702 in the casing 109, the upper anchor 300 can be activated via a command from the surface. The solenoid 327 can be activated to release the piston 323. The movement of the piston 323 can cause the arms 309, 311 to radially expand outward with a sufficient radial force to secure the upper anchor 300 to the inner surface 110 of the casing 109. The cams 322 on the arms 309, 311 can prevent the downward movement of the upper anchor 300 due to drag from fluid flowing through the casing 109. The lower anchor 500 can be released from the upper anchor 300. The upper anchor 300 can remain attached to the casing 109. The lower anchor 500 can be moved further down into the casing 109, e.g., by pumping a fluid or using a downhole tractor. As such, in some embodiments, a downhole tractor can be connected to the lower anchor 500 and configured to move the lower anchor 500 within the downhole casing 109. The cable 307 can freely pass through the upper anchor 300.

When the lower anchor 500 reaches the required depth within the casing 109, the lower anchor 500 can be deployed by sending a command from the surface. The lower anchor 500, upon being deployed, can attach to the inner surface 110 of the casing 109 by switching the switchable magnets 503 from the off state to the on state. After the lower anchor 500 has been deployed, the cable 307 can be pulled under tension from the surface to keep the section of the cable 307 between the upper anchor 300 and the lower anchor 500 under a desired tension. The tension applied to the cable 307 can be sufficient to maintain the cable 307 off the inner surface 110 of the casing 109.

A frac operation can be continued and frac monitoring can be carried out via the optical fiber(s) disposed within the cable 307. After the monitoring operation has been completed, the lower anchor 500 can be released, e.g., via a surface command. The cable 307 can be pulled from the surface. The lower anchor 500 can be re-attached to upper anchor 300. The re-attachment of the lower anchor 500 to the upper anchor 300 can cause the upper anchor 300 to be closed and transitioned to the pull-out position. The anchor assembly 700 can then be retrieved to the surface via the cable 307.

In some embodiments, the anchor assembly 700 can be conveyed via the cable 307 to a location of interest within the downhole casing 109. The first anchor 300 can be activated to cause the plurality of arms 309, 311 to radially expand outward with a sufficient radial force to secure the first anchor 300 to the inner surface 110 of the downhole casing 109. The second anchor 500 can be released from the first anchor 300 upon activation of the first anchor 300. The second anchor 500 can be moved further into the downhole casing 109 away from the first anchor 300 such that a portion of the cable 307 can span a distance between the first anchor 300 and the second anchor 500. The one or more switchable magnets 503 in the second anchor 500 can be switched from the non-magnetized state to the magnetized state to secure the second anchor 500 to the inner surface 110 of the downhole casing 109. A tension can be applied to the cable 307 from a surface location by applying a force to the cable 307, e.g., a rotation of a reel the cable 307 is reeled on at the surface location.

Figure 8:
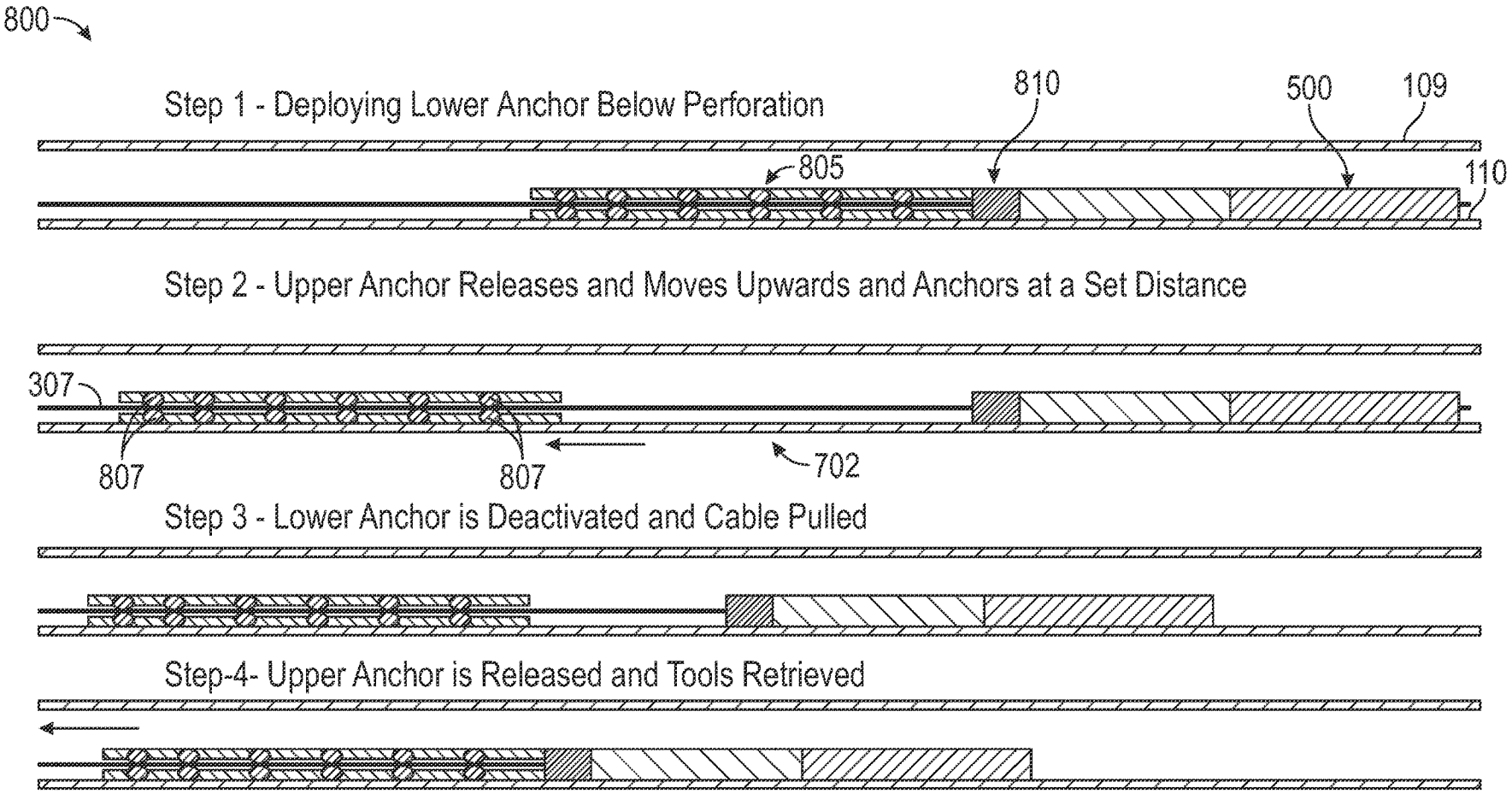
FIG. 8 depicts another illustrative anchor assembly that includes an upper anchor and a lower anchor with the lower anchor in a deployed configuration, the upper anchor and the lower anchor in a deployed configuration, the lower anchor in a released configuration, and the upper and lower anchors in a closed and pull-out configuration, according to one or more embodiments described.

FIG. 8 depicts another illustrative anchor assembly 800 that includes an upper anchor 805 and the lower anchor 500, with the lower anchor 500 in a deployed configuration, the upper anchor 805 and the lower anchor 500 in a deployed configuration, the lower anchor 500 in a released configuration, and the upper anchor 805 and the lower anchor 500 in a closed and pull-out configuration, according to one or more embodiments. The anchor assembly 800 can be lowered into the casing 109. At a desired depth below the perforation 702, the lower anchor 500 can be activated, e.g., via a command from the surface. The switchable magnets can be switched on, e.g., via a battery-operated circuit, and the lower anchor 500 can attach to the inner surface 110 of the casing 109.

In some embodiments, the upper anchor 805 can include a plurality of wheels 807 and a plurality of switchable magnets. The switchable magnets in the upper anchor 805 can be the same or similar to the switchable magnets 100 and 503 described above with reference to FIGS. 1 and 5. The switchable magnets in the upper anchor 805 can be switched between the off position and the on position in the same or similar manner the switchable magnets 100, 503 can be switched, e.g., the electro-hydraulic device 505. When the lower anchor 500 activates, the upper anchor 805 can be activated. In some embodiments, the upper anchor 805 can be powered via a battery. Upon activation of the upper anchor 805, the upper anchor 805 can be released from the lower anchor 500 and the wheels 807 can grab the cable 307 and start turning, which can move the upper anchor 805 toward the surface along the cable 307.

In some embodiments, the length of the cable 307 the upper anchor 805 travels along can be measured, e.g., by counting the number of rotations the wheels make. In other embodiments, the length of the cable 307 the upper anchor 805 travels along can be measured, e.g., via one or more rollers and electrical encoders. In some embodiments, the upper anchor 805 can be programed to move a pre-determined length along the cable 307 and upon reaching the pre-determined length the upper anchor 805 can be activated to secure the upper anchor 805 to the downhole casing 109. In some embodiments, the upper anchor 805 can be configured to be secured to the downhole casing 109 for a pre-determined period of time and once the pre-determined period of time has passed the upper anchor 805 can be automatically released by switching the switchable magnets from the on position to the off position. When the upper anchor 805 has traveled a desired distance above the perforation 702, the upper anchor magnets can be activated. In some embodiments, the cable 307 can be pulled under tension from the surface to keep the section of the cable 307 between the upper anchor 805 and the lower anchor 500 under a desired tension. In other embodiments, with the upper anchor 805 secured to the casing 109, the wheels 807 can be further turned to apply the desired tension to the cable 307. The tension applied to the cable 307 via the surface and/or via the upper anchor 805 can be sufficient to maintain the cable 307 off the inner surface 110 of the casing 109.

In some embodiments, the upper anchor 805 can include a resistance mechanism that can ensure the downward motion of the cable 307 through the upper anchor 805 happens only after predetermined force has been applied, which can determine the tension on the cable 307 located between the upper anchor 805 and the lower anchor 500. The frac operation can be carried out. After the frac operation, the lower anchor 500 can be released and pulled via the cable 307 toward the upper anchor 805. The upper anchor 805 can be released when the lower anchor 500 contacts a release head of the upper anchor 805.

In some embodiments, the anchor assembly 800 can be conveyed via the cable 307 to a location of interest within the downhole casing 109. The one or more switchable magnets 503 in the second anchor 500 can be switched from the non-magnetized state to the magnetized state to secure the second anchor 500 to the inner surface 110 of the downhole casing 109. The first anchor 805 can be released from the second anchor 500 upon activation of the second anchor 500. The plurality of wheels 807 can be activated within the first anchor 805 to move the first anchor 805 toward a surface location and away from the second anchor 500 such that a portion of the cable 307 can span a distance between the first anchor 805 and the second anchor 500. The one or more switchable magnets in the first anchor 805 can be switched from the non-magnetized state to the magnetized state to secure the first anchor 805 to the inner surface 110 of the downhole casing 109. A tension can be applied to the cable from a surface location by applying a force, e.g., a rotation of a reel the cable 307 is reeled on at the surface location and/or further actuating the wheels 807, to the cable 307.

While the present disclosure may be susceptible to various modifications and alternative forms, specific embodiments have been shown by way of example in the drawings and have been described in detail herein. However, it should be understood that the present disclosure is not intended to be limited to the particular forms disclosed. Rather, the present disclosure is intended to cover all modifications, equivalents, and alternatives falling within the spirit and scope of the present disclosure as defined by the following appended claims.

Certain embodiments and features have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim can be not defined above, it should be given the broadest definition persons in the pertinent art have given that term as reflected in at least one printed publication or issued patent. Furthermore, all patents, test procedures, and other documents cited in this application are fully incorporated by reference to the extent such disclosure can be not inconsistent with this application and for all jurisdictions in which such incorporation can be permitted.

While certain preferred embodiments of the present invention have been illustrated and described in detail above, it can be apparent that modifications and adaptations thereof will occur to those having ordinary skill in the art. It should be, therefore, expressly understood that such modifications and adaptations may be devised without departing from the basic scope thereof, and the scope thereof can be determined by the claims that follow.

What is claimed is:

1. An anchor assembly for use on a cable, comprising:

a first anchor configured to be releasably connected to a second anchor, the first anchor defining a bore therethrough configured to receive and permit the cable to move therethrough such that the cable is configured to connect to the second anchor, wherein:

the second anchor comprises one or more switchable magnets each configured to switch between a non-magnetized state and a magnetized state, and when the anchor assembly is located within a downhole casing and the one or more switchable magnets are switched from the non-magnetized state to the magnetized state, the one or more switchable magnets are configured to secure the second anchor to an inner surface of the downhole casing.

2. The anchor assembly of claim 1, wherein the first anchor comprises a collet assembly configured to connect to a fishing head neck of the second anchor.

3. The anchor assembly of claim 1, wherein the one or more switchable magnets comprise a housing, at least two permanent magnets disposed within the housing, and a switch configured to cause relative rotation between the at least two permanent magnets disposed within the housing.

4. The anchor assembly of claim 3, wherein the switch is configured to be mechanically actuated via an electro-hydraulic device.

5. The anchor assembly according to claim 1, wherein the lower anchor further comprises a timed fail-safe mechanism configured to release the lower anchor automatically in the event of power failure.

6. The anchor assembly according to claim 1, wherein the lower anchor further comprises a timed fail-safe mechanism configured to release the lower anchor after a predetermined period of time has elapsed after the lower anchor was secured to the inner surface of the downhole casing.

7. The anchor assembly according to claim 1, wherein:

when the anchor assembly is located within the downhole casing, the first anchor is configured to be activated to cause a plurality of arms to radially expand outward with a sufficient radial force to secure the first anchor to the inner surface of the downhole casing, activation of the first anchor causes the second anchor to be disconnected from the first anchor such that the second anchor is moveable away from the first anchor to a location located further down the downhole casing, and when the second anchor is moved away from the first anchor and secured to the inner surface of the downhole casing a tension is configured to be applied to the cable from a surface location by applying a force to the cable.

8. The anchor assembly of claim 7, wherein each of the plurality of arms of the first anchor comprise a cam configured to engage with the inner surface of the downhole casing in a manner that prevents the upper anchor from moving further into the downhole casing and allows the upper anchor to move within the downhole casing toward the surface location.

9. The anchor assembly according to claim 1, wherein:

when the anchor assembly is located within the downhole casing, the first anchor is configured to be activated to cause a plurality of arms to radially expand outward with a sufficient radial force to secure the first anchor to the inner surface of the downhole casing, after the first anchor is activated, an electromechanical release mechanism is configured to be activated to cause the second anchor to be disconnected from the first anchor such that the second anchor is moveable away from the first anchor to a location located further down the downhole casing, and when the second anchor is moved away from the first anchor and secured to the inner surface of the downhole casing, a tension is configured to be applied to the cable from a surface location by applying a force to the cable.

10. The anchor assembly according to claim 1, wherein the first anchor comprises a plurality of wheels configured to engage with the cable when located within the bore defined by the first anchor and one or more switchable magnets configured to switch between a non-magnetized state and a magnetized state, and when the anchor assembly is located within the downhole casing and the one or more switchable magnets in the first anchor are switched from the non-magnetized state to the magnetized state, the one or more switchable magnets in the first anchor are configured to secure the first anchor to the inner surface of the downhole casing.

11. The anchor assembly of claim 10, wherein:

when the anchor assembly is located within the downhole casing, the second anchor is configured to be activated to cause the one or more switchable magnets to secure the second anchor to the inner surface of the casing, when the second anchor is secured to the inner surface of the downhole casing, the plurality of wheels are configured to engage the cable to move the first anchor toward a surface location and away from the second anchor, and when the first anchor is secured to the inner surface of the downhole casing, a tension is configured to be applied to the cable from a surface location by applying a force to the cable and/or the wheels are configured to further turn to apply a force to the cable.

12. A process for conveying an anchor assembly into a downhole casing, comprising:

conveying the anchor assembly via a cable to a location of interest within the downhole casing, the anchor assembly comprising a first anchor releasably connected to a second anchor, wherein:

the first anchor defines a bore therethrough that the cable passes through such that the cable is connected to the second anchor, and the second anchor comprises one or more switchable magnets each configured to switch between a non-magnetized state and a magnetized state;

activating the first anchor to cause a plurality of arms to radially expand outward with a sufficient radial force to secure the first anchor to an inner surface of the downhole casing;

releasing the second anchor from the first anchor upon activation of the first anchor;

moving the second anchor further into the downhole casing away from the first anchor such that a portion of the cable spans a distance between the first anchor and the second anchor;

switching the one or more switchable magnets from the non-magnetized state to the magnetized state to secure the second anchor to the inner surface of the downhole casing; and applying a tension to the cable from a surface location by applying a force to the cable.

13. The process of claim 12, wherein the cable comprises one or more optical fibers therein, and the process further comprises using the one or more optical fibers to monitor a path of a frac fluid after a fracking operation to assess the effectiveness of the frac treatment.

14. The process of claim 12, wherein the second anchor is moved further into the downhole casing by a downhole tractor, pumping a fluid into the downhole casing, or a combination thereof.

15. The process of claim 12, wherein the one or more switchable magnets comprise a housing, at least two permanent magnets disposed within the housing, and a switch configured to cause relative rotation between the at least two permanent magnets disposed within the housing.

16. The process of claim 15, wherein each of the one or more switchable magnets in the second anchor is switched via an electro-hydraulic device.

17. The process of claim 12, wherein the force is applied to the cable via equipment located at a surface location.

18. A process for conveying an anchor assembly into a downhole casing, comprising:

conveying the anchor assembly via a cable to a location of interest within the downhole casing, the anchor assembly comprising a first anchor releasably connected to a second anchor, wherein:

the first anchor defines a bore therethrough that the cable passes through such that the cable is connected to the second anchor, the first anchor comprises a plurality of wheels configured to engage with the cable disposed within the bore defined by the first anchor the first anchor comprises one or more switchable magnets each configured to switch between a non-magnetized state and a magnetized state, and the second anchor comprises one or more switchable magnets each configured to switch between a non-magnetized state and a magnetized state;

switching the one or more switchable magnets in the second anchor from the non-magnetized state to the magnetized state to secure the second anchor to an inner surface of the downhole casing;

releasing the first anchor from the second anchor upon activation of the second anchor;

activating the plurality of wheels within the first anchor to move the first anchor toward a surface location and away from the second anchor such that a portion of the cable spans a distance between the first anchor and the second anchor;

switching the one or more switchable magnets in the first anchor from the non-magnetized state to the magnetized state to secure the first anchor to the inner surface of the downhole casing; and applying a tension to the cable from a surface location by applying a force to the cable.

19. The process of claim 18, wherein the force is applied to the cable via equipment located at a surface location and/or by further turning the wheels engaged with the cable.

20. The process of claim 18, wherein the cable comprises one or more optical fibers therein, and the process further comprises using the one or more optical fibers to monitor a path of a frac fluid after a fracking operation to assess the effectiveness of the frac treatment.

21. The process of claim 18, wherein the one or more switchable magnets in each of the first anchor and the second anchor comprise a housing, at least two permanent magnets disposed within the housing, and a switch configured to cause relative rotation between the at least two permanent magnets disposed within the housing.

22. The process of claim 21, wherein the one or more switchable magnets in each of the first anchor and the second anchor are switched via an electro-hydraulic device.

* * * * *